US009608373B2

(12) United States Patent
Wu et al.

(10) Patent No.: US 9,608,373 B2
(45) Date of Patent: Mar. 28, 2017

(54) CONNECTOR ASSEMBLY AND CONNECTOR PRODUCT

(71) Applicants: Tyco Electronics (Shanghai) Co. Ltd., Shanghai (CN); Tyco Electronics Corporation, Berwyn, PA (US)

(72) Inventors: Jianfeng Wu, Shanghai (CN); Christopher Scott Hertzler, Carlisle, PA (US); Jiucai Fan, Shanghai (CN); Wei-guo Li, Shanghai (CN)

(73) Assignees: Tyco Electronics (Shanghai) Co., Ltd., Shanghai (CN); Tyco Electronics Coporation, Berwyn, PA (US)

( * ) Notice: Subject to any disclaimer, the term of this patent is extended or adjusted under 35 U.S.C. 154(b) by 0 days.

(21) Appl. No.: 14/405,366

(22) PCT Filed: Jun. 5, 2013

(86) PCT No.: PCT/IB2013/054633
§ 371 (c)(1),
(2) Date: Dec. 3, 2014

(87) PCT Pub. No.: WO2013/183015
PCT Pub. Date: Dec. 12, 2013

(65) Prior Publication Data

US 2015/0147901 A1 May 28, 2015

(30) Foreign Application Priority Data

Jun. 8, 2012 (CN) ..... 2012 2 0268861 U

(51) Int. Cl.
*H01R 13/627* (2006.01)
*H01R 13/639* (2006.01)

(52) U.S. Cl.
CPC ..... *H01R 13/639* (2013.01); *H01R 13/6272* (2013.01)

(58) Field of Classification Search
CPC ..... H01R 13/639; H01R 13/6392; H01R 13/6272; H01R 13/6271
(Continued)

(56) References Cited

U.S. PATENT DOCUMENTS 5,605,471 A 2/1997 Plyler
6,261,116 B1 7/2001 Ceru

FOREIGN PATENT DOCUMENTS

EP 0848456 A2 6/1998
KR 2008 0088710 A 10/2008

OTHER PUBLICATIONS

International Preliminary Report on Patentability issued by the International Bureau of WIPO, Geneva, Switzerland, dated Dec. 18, 2014 for International Application No. PCT/IB2013/054633; 8 pages.

(Continued)

*Primary Examiner* — Khiem Nguyen
(74) *Attorney, Agent, or Firm* — Faegre Baker Daniels LLP

(57) ABSTRACT

A connector assembly comprising: a first connector having a housing on which an elastic locking piece is suspended; a second connector having a housing on which a locking member mating with the elastic locking piece is formed so as to lock the first and second connectors together when the first and second connectors are mated together; and a connector position assurance device having a first stopper and a second stopper behind the first stopper. A first mating stopper is formed on the elastic locking piece, and a second mating stopper is formed on the housing of the first connector. The connector position assurance device only can be inserted into a first position under the elastic locking piece of the first connector when the first and second connectors are separate from each other. At the first position, the first stopper of the connector position assurance device is abutted (Continued)

against the first mating stopper of the first connector to prevent the connector position assurance device from being further pushed forward, and at the first position, the second stopper of the connector position assurance device is abutted against the second mating stopper of the first connector to prevent the connector position assurance device from being pulled out backward.

22 Claims, 9 Drawing Sheets

(58) Field of Classification Search
USPC ..... 439/350, 352, 353, 357
See application file for complete search history.

(56) References Cited

OTHER PUBLICATIONS

International Search Report and Written Opinion issued by the European Patent Office, dated Sep. 19, 2013, for International Application PCT/IB2013/054633; 9 pages.

CONNECTOR ASSEMBLY AND CONNECTOR PRODUCT

CROSS-REFERENCE TO RELATED APPLICATION

This application claims the benefit of Chinese Patent Application No. 201220268861.4 filed on Jun. 8, 2012 in the State Intellectual Property Office of China, the whole disclosure of which is incorporated herein by reference.

BACKGROUND OF THE INVENTION

Field of the Invention

The present invention relates to a connector assembly, more particularly, relates to a connector assembly having a connector position assurance device. The present invention also relates to a connector product having the connector position assurance device.

Description of the Related Art

In traditional design, a plug connector and a receptacle connector can be locked with each other by locking members formed thereon, for example, releasable elastic locking members. Once the plug connector is mated with the receptacle connector, the elastic locking members of the plug and receptacle connectors are automatically locked with each other to hold the plug and receptacle connectors in the mated condition. However, the elastic locking members may be unintentionally released under an external force. In order to reliably keep the plug and receptacle connectors in the locked state, a connector position assurance device (CPA) is provided to limit a deformation of the elastic locking members to an extent of preventing the elastic locking members from being unintentionally released under the external force.

In the traditional design, the CPA is an individual small member separated from the plug and receptacle connectors. When the plug and receptacle connectors are mated with each other, the CPA can be inserted underneath the elastic locking members of the plug and receptacle connectors to limit the downward deformation of the elastic locking members. When it needs to separate the plug and receptacle connectors, the CPA must be pulled out of the plug and receptacle connectors in advance.

Since the CPA is an individual small member separated from the plug and receptacle connectors in the prior arts, the CPA may be accidently lost or cannot be found when an operator needs to use the CPA to hold the plug and receptacle connectors in the locked state.

SUMMARY OF THE INVENTION

The present invention has been made to overcome or alleviate at least one aspect of the above mentioned disadvantages.

Accordingly, it would be advantageous to provide a connector assembly having a CPA connected thereto so that the CPA cannot be lost and can be easily found in use.

Accordingly, it would be also advantageous to provide a connector product having a CPA connected thereto so that the CPA cannot be lost and can be easily found in use.

According to an aspect of the present invention, there is provided a connector assembly comprising: a first connector having a housing on which an elastic locking piece is suspended; a second connector having a housing on which a locking member mating with the elastic locking piece is formed so as to lock the first and second connectors together when the first and second connectors are mated together; and a connector position assurance device having a first stopper and a second stopper behind the first stopper, wherein a first mating stopper is formed on the elastic locking piece, and a second mating stopper is formed on the housing of the first connector, wherein the connector position assurance device only can be inserted into a first position under the elastic locking piece of the first connector when the first and second connectors are separate from each other, wherein at the first position, the first stopper of the connector position assurance device is abutted against the first mating stopper of the first connector to prevent the connector position assurance device from being further pushed forward, and at the first position, the second stopper of the connector position assurance device is abutted against the second mating stopper of the first connector to prevent the connector position assurance device from being pulled out backward.

In an embodiment according to the present invention, wherein a first stopper release member is formed on the housing of the second connector; wherein when the first and second connectors are mated together, the first stopper release member of the second connector jacks up the first mating stopper of the elastic locking piece of the first connector to separate the first mating stopper from the first stopper so that the connector position assurance device can be further pushed forward from the first position to a second position; wherein at the second position, the connector position assurance device holds the elastic locking piece of the first connector in a locked state where the elastic locking piece of the first connector is locked with the locking member of the second connector.

In another embodiment according to the present invention, wherein a first positioning feature is formed on the connector position assurance device, and a first mating positioning feature is formed on the housing of the first connector, wherein when the connector position assurance device is inserted into the first position, the first positioning feature of the connector position assurance device is mated with the first mating positioning feature of the first connector.

In another embodiment according to the present invention, wherein a second positioning feature is formed on the connector position assurance device behind the first positioning feature; wherein when the connector position assurance device is pushed forward from the first position to the second position, the first positioning feature of the connector position assurance device is disengaged from the first mating positioning feature of the first connector, and the second positioning feature of the connector position assurance device is mated with the first mating positioning feature of the first connector.

In another embodiment according to the present invention, wherein the connector position assurance device comprising: a pair of elongated arms separate from each other by a spacing slot; and a bottom plate recessedly disposed in a rear portion of the spacing slot.

In another embodiment according to the present invention, wherein the first stopper is configured to be a protrusion formed on and projected upward from the bottom plate; and wherein the first mating stopper is configured to be an elastic finger formed in an opening of the first elastic piece and aslant extending downward beyond a bottom surface of the first elastic piece.

In another embodiment according to the present invention, wherein the second stopper is configured to be an elastic finger formed in an opening of the bottom plate of the connector position assurance device and aslant extending downward beyond a bottom surface of the bottom plate; and wherein the second mating stopper is configured to be a protrusion formed on and projected upward from the housing of the first connector.

In another embodiment according to the present invention, wherein a first chamber defined by a pair of side walls and a top wall is formed on the housing of the first connector; and wherein the elastic locking piece is suspended in the first chamber from the top wall.

In another embodiment according to the present invention, wherein the first positioning feature is configured to be a pair of recesses formed in outer side walls of the pair of elongated arms; and wherein the first mating positioning feature is configured to be a pair of protrusions formed on the pair of side walls in the first chamber.

In another embodiment according to the present invention, wherein the second positioning feature is configured to be a pair of mating protrusions formed on the outer side walls of the pair of elongated arms and mated with the pair of protrusions on the side walls in the first chamber.

In another embodiment according to the present invention, wherein a guide groove is formed in a rear portion of the bottom plate of the connector position assurance device and mated with the second mating stopper of the housing of the first connector to guide the insertion of the connector position assurance device.

In another embodiment according to the present invention, wherein a pair of first locking hooks are formed on free ends of the pair of elongated arms of the connector position assurance device; wherein at least one second locking hook is formed on a front end of the elastic locking piece of the first connector; and wherein when the first and second connectors are mated together and when the connector position assurance device is inserted into the second position, the second locking hook of the elastic locking piece of the first connector is locked with the locking member of the second connector, and the first locking hooks of the connector position assurance device is locked with the second locking hook of the elastic locking piece of the first connector.

In another embodiment according to the present invention, wherein a second chamber defined by a pair of side walls and a top wall is formed on the housing of the second connector and adapted to insert the elastic locking piece therein.

In another embodiment according to the present invention, wherein a window is formed in the top wall of the second chamber to watch whether the connector position assurance device is inserted into the second position.

In another embodiment according to the present invention, wherein the top wall of the second chamber comprises a section of lateral plate constituting the locking member of the second connector.

In another embodiment according to the present invention, wherein the first stopper release member is configured to be a pair of projections formed on the housing of the second connector; and wherein a distance between the pair of projections is larger than a width of the first stopper to allow the first stopper to pass through between the pair of projections during inserting the connector position assurance device from the first position to the second position.

In another embodiment according to the present invention, wherein a pair of protruded platforms are formed on the housing of the second connector and padded under the free ends of the pair of elongated arms when the connector position assurance device is inserted into the second position so as to limit a downward deformation space of the pair of elongated arms and the elastic locking piece lied against the elongated arms; and wherein the downward deformation space is limited to an extent of preventing the second locking hook of the elastic locking piece of the first connector from being released from the locking member of the second connector and allowing the first locking hooks of the elongated arms of the connector position assurance device to be released from the second locking hook of the elastic locking piece of the first connector.

In another embodiment according to the present invention, wherein when the first locking hooks of the elongated arms of the connector position assurance device are released from the second locking hook of the elastic locking piece of the first connector and when the connector position assurance device is withdrawn from the second position to the first position, the elastic locking piece of the first connector can deform downward to an extent of allowing the elastic locking piece of the first connector to be released from the locking member of the second connector.

In another embodiment according to the present invention, wherein the first connector is a plug connector, and the second connector is a receptacle connector.

According to another aspect of the present invention, there is provided a connector product comprising the above mentioned first connector and the above mentioned connector position assurance device, wherein the connector position assurance device has been inserted into the first position of the first connector.

In various embodiments of the present invention, the CPA can be inserted into a first position of the first connector where the CPA neither be pushed forward nor pulled out backward. Accordingly, the CPA can be stably pre-attached to the housing of the first connector and sold together with the first connector before the first connector is mated to the second connector. Thereby, the CPA cannot be lost and can be easily found when an operator needs to use the CPA to hold the first and second connectors in a locked position.

BRIEF DESCRIPTION OF THE DRAWINGS

The above and other features of the present invention will become more apparent by describing in detail embodiments thereof with reference to the accompanying drawings, in which.

DETAILED DESCRIPTION OF PREFERRED EMBODIMENTS OF THE INVENTION

Figure 1:
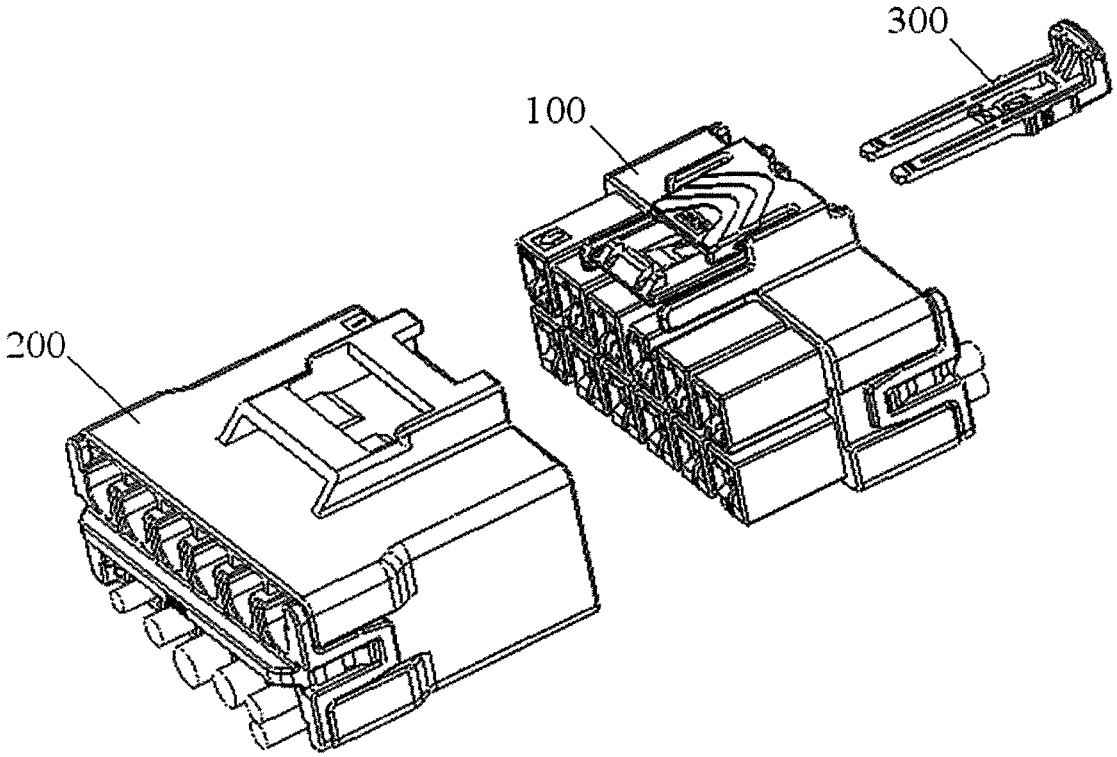
FIG. 1 is an illustrative exploded view of a connector assembly according to an embodiment of the present invention.

The embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

FIG. 1 is an illustrative exploded view of a connector assembly according to an embodiment of the present invention.

As shown in FIG. 1, the connector assembly mainly comprises a first connector 100, a second connector 200 and a Connector Position Assurance device (CPA) 300.

Figure 2:
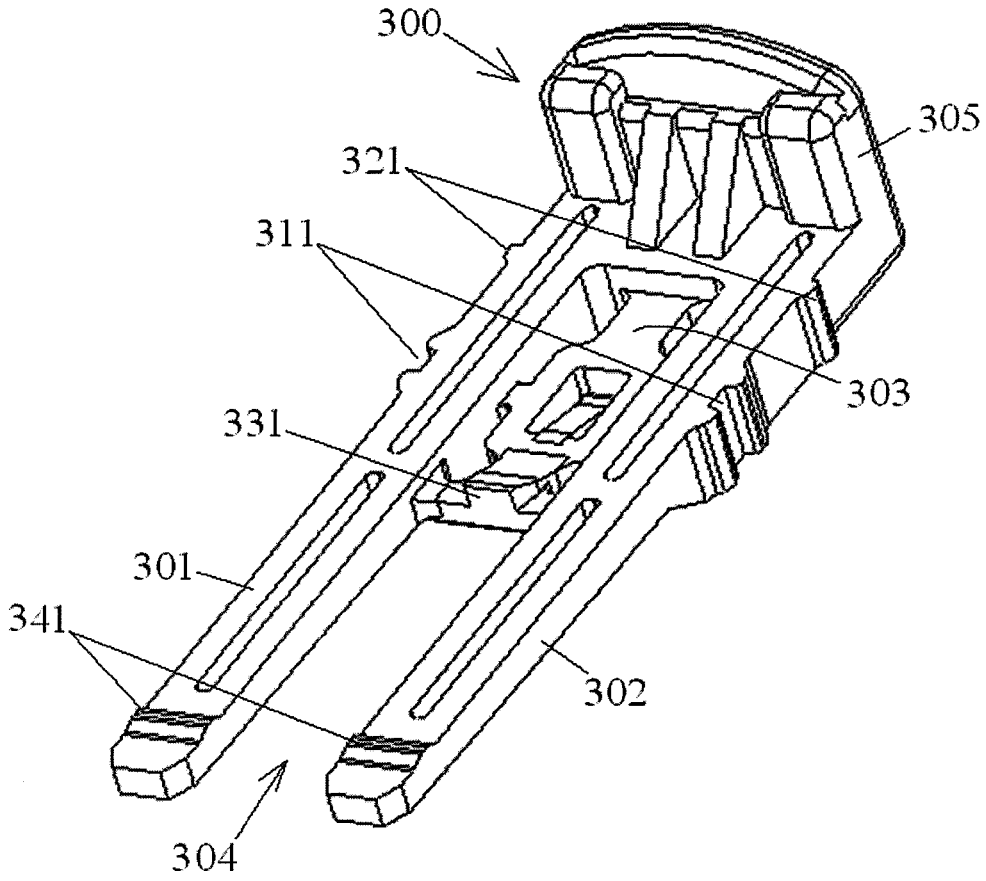
FIG. 2 is an illustrative perspective view of a connector position assurance device shown in FIG. 1 when viewed from a front side thereof.
Figure 3:
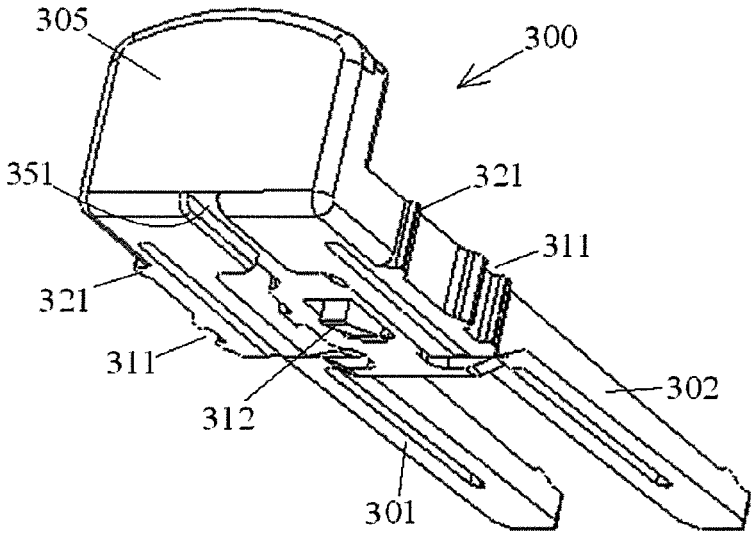
FIG. 3 is an illustrative perspective view of a connector position assurance device shown in FIG. 1 when viewed from a bottom side thereof.

FIG. 2 is an illustrative perspective view of the CPA 300 shown in FIG. 1 when viewed from a front side thereof. FIG. 3 is an illustrative perspective view of the CPA 300 shown in FIG. 1 when viewed from a bottom side thereof.

As shown in FIGS. 2-3, the CPA 300 has a first stopper 331 and a second stopper 312 behind the first stopper 331 in an insertion direction of the CPA into the second connector 200.

Figure 4:
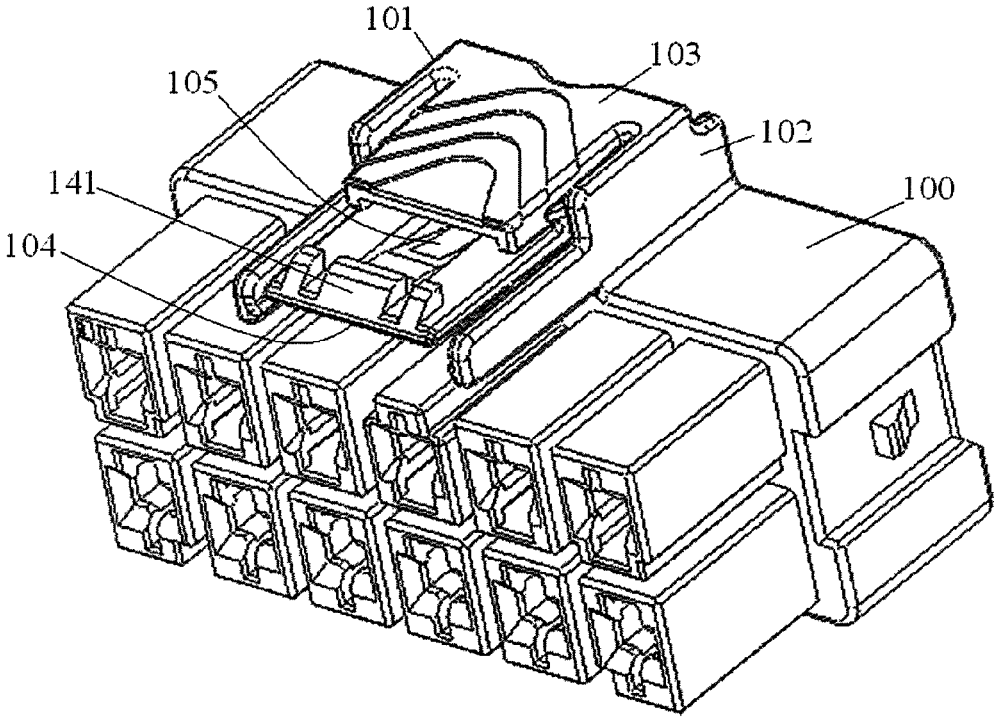
FIG. 4 is an illustrative perspective view of a first connector shown in FIG. 1.
Figure 5:
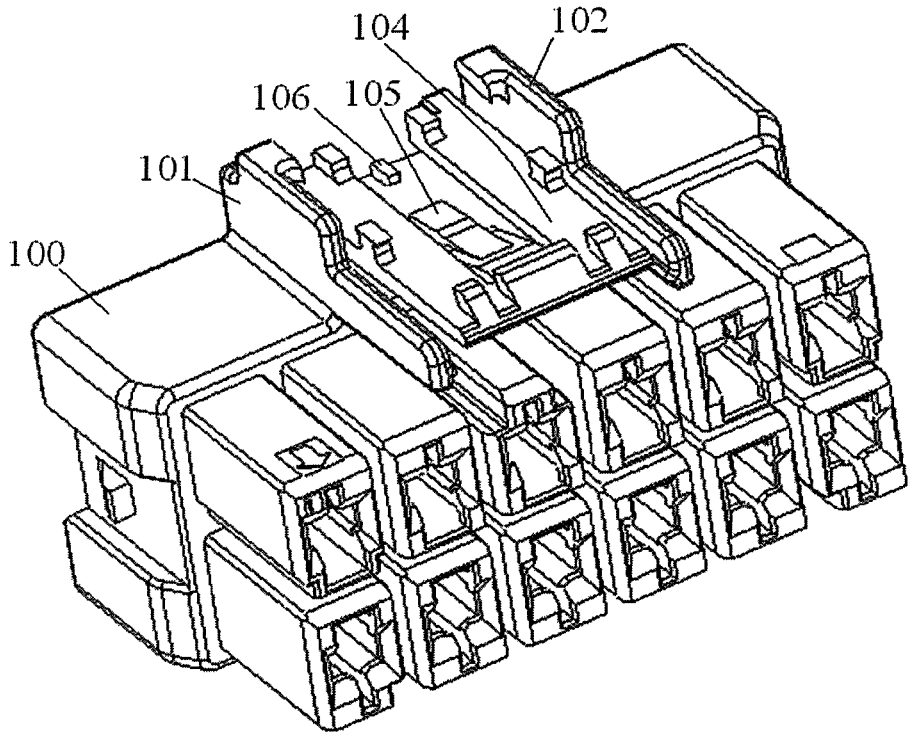
FIG. 5 is an illustrative view of the first connector of FIG. 4, wherein a top wall of a first chamber is removed.
Figure 6:
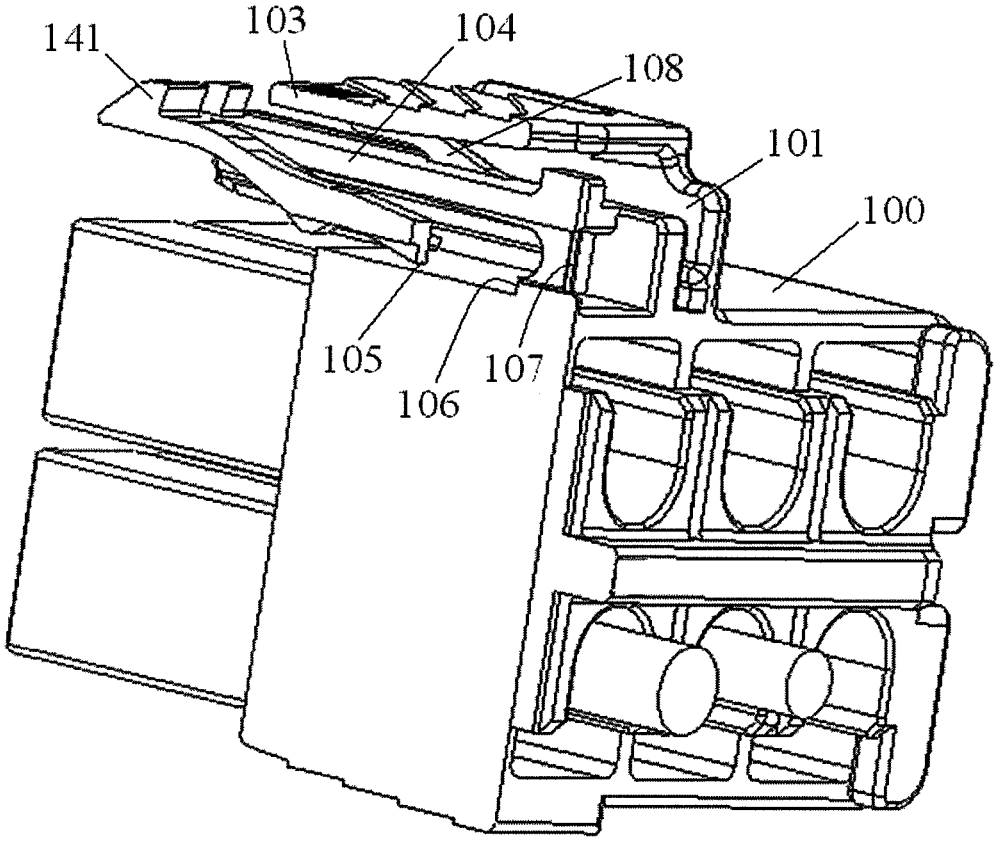
FIG. 6 is a cross section view of the first connector of FIG. 4.

FIG. 4 is an illustrative perspective view of the first connector 100 shown in FIG. 1; FIG. 5 is an illustrative view of the first connector 100 of FIG. 4, wherein a top wall of a first chamber is removed; FIG. 6 is a cross section view of the first connector 100 of FIG. 4.

As shown in FIGS. 4-6, the first connector 100 has a first housing on which an elastic locking piece 104 is suspended. A first mating stopper 105 is formed on the elastic locking piece 104, and a second mating stopper 106 is formed on the first housing of the first connector 100.

Figure 7:
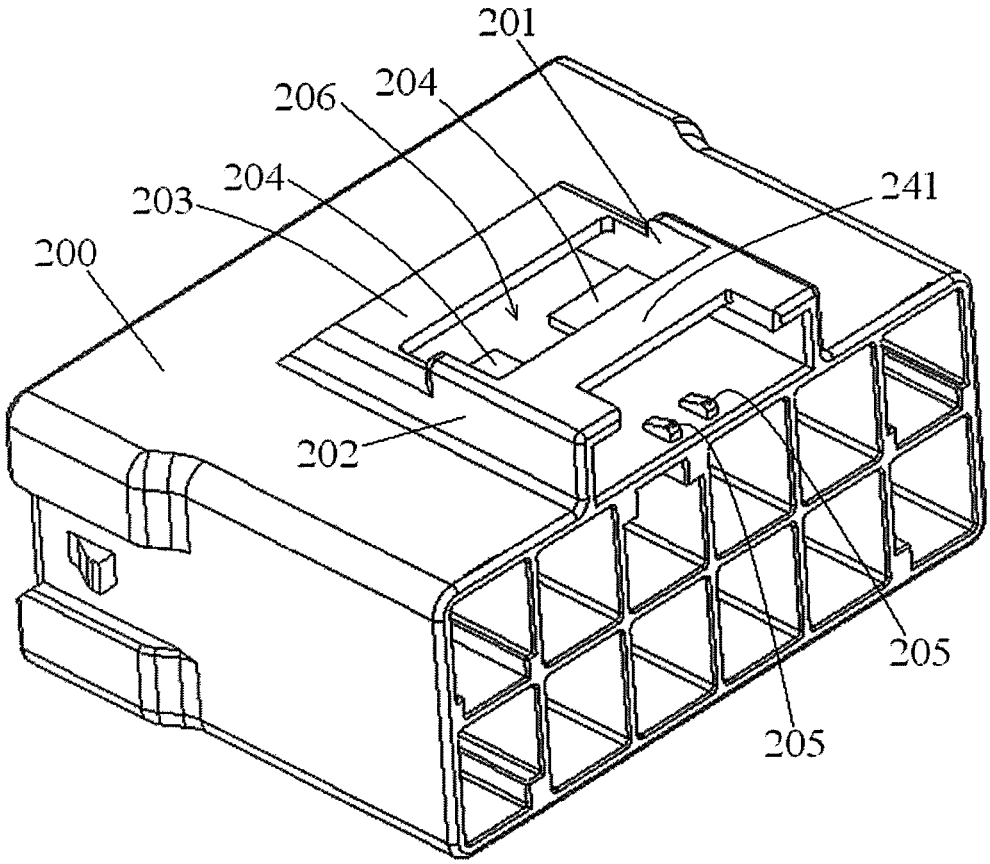
FIG. 7 is an illustrative perspective view of a second connector shown in FIG. 1.
Figure 8:
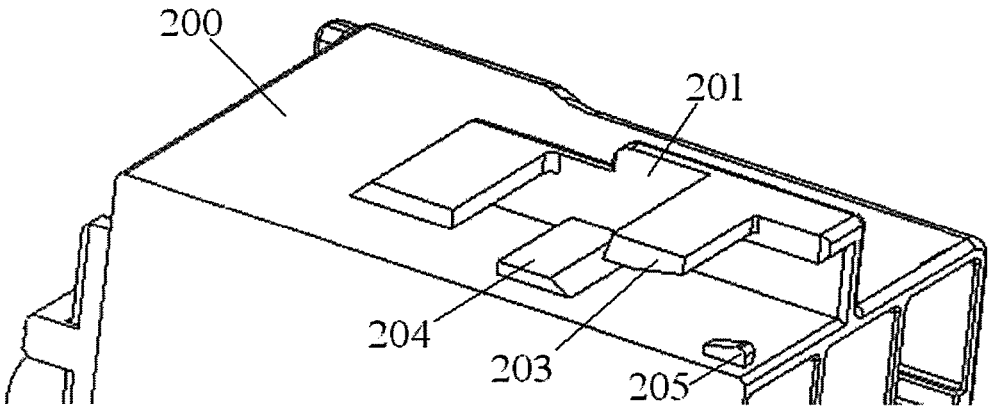
FIG. 8 is a cross section view of the second connector of FIG. 7.

FIG. 7 is an illustrative perspective view of the second connector 200 shown in FIG. 1; FIG. 8 is a cross section view of the second connector 200 of FIG. 7.

As shown in FIGS. 7-8, the second connector 200 has a second housing on which a locking member 241 mated with the elastic locking piece 104 is formed so as to lock the first and second connectors 100, 200 together when the first and second connectors 100, 200 are mated together.

Figure 9:
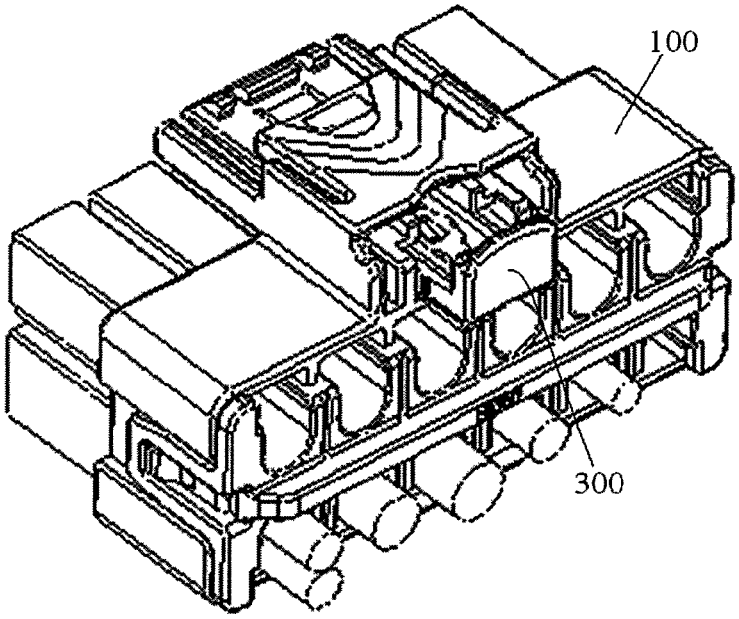
FIG. 9 is an illustrative view of a connector product, wherein the connector position assurance device of FIG. 1 has been inserted into a first position (pre-assembly position) of the first connector.
Figure 10:
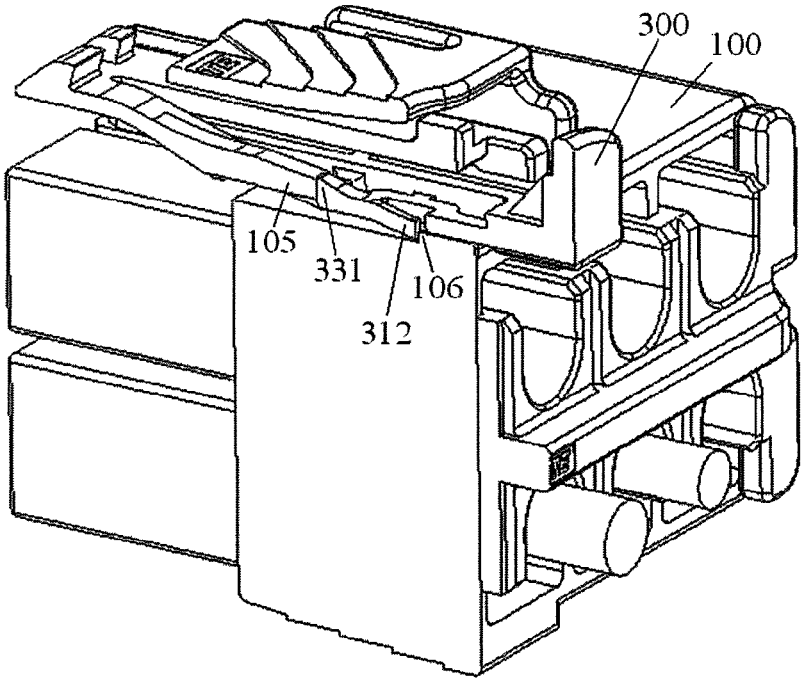
FIG. 10 is a cross section view of the connector product shown in FIG. 9.

FIG. 9 is an illustrative view of a connector product comprising the first connector 100 and the CPA 300, wherein the CPA 300 of FIG. 1 has been inserted into a first position (pre-assembly position) of the first connector 100. FIG. 10 is a cross section view of the connector product shown in FIG. 9.

As shown in FIGS. 9-10, before the first connector 100 is inserted into the second connector 200 or when the first and second connectors 100, 200 are separate from each other, the CPA 300 only can be inserted into the first position under the elastic locking piece 104 of the first connector 100.

As shown in FIG. 10, at the first position, the first stopper 331 of the CPA 300 is abutted against the first mating stopper 105 of the first connector 100 to prevent the CPA 300 from being further pushed forward, and at the first position, the second stopper 312 of the CPA 300 is abutted against the second mating stopper 106 of the first connector 100 to prevent the CPA 300 from being pulled out backward. In this way, the CPA 300 is configured as an attachment member that cannot be separated from the first connector 100 and can be used and sold together with the first connector 100. Accordingly, the CPA 300 cannot be lost and can be easily found when an operator needs to use the CPA 300 to hold the first and second connectors 100, 200 in a locked position.

As shown in FIGS. 7-8, a first stopper release member 205 is formed on the second housing of the second connector 200.

Figure 11:
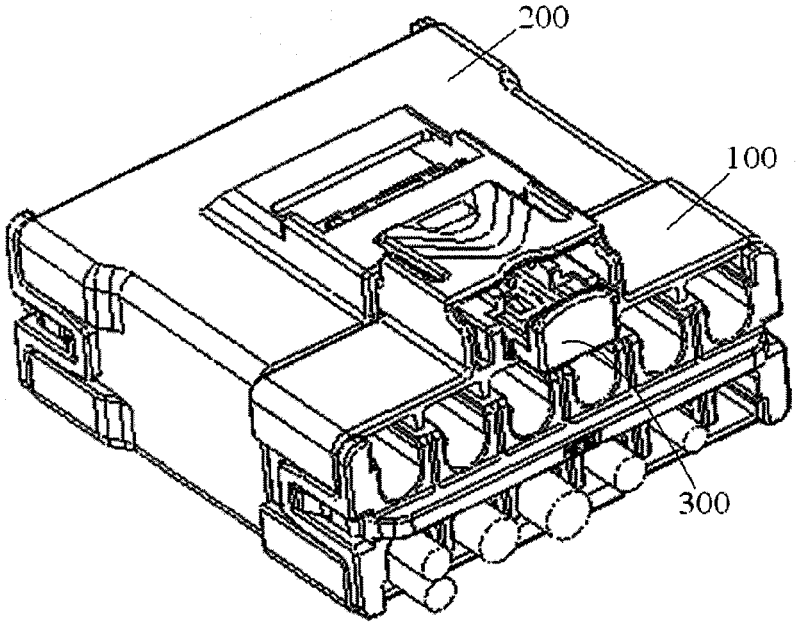
FIG. 11 is an illustrative view of a connector assembly, wherein the first connector of the connector product of FIG. 9 has been assembled into the second connector and the connector position assurance device is located in the first position.
Figure 12:
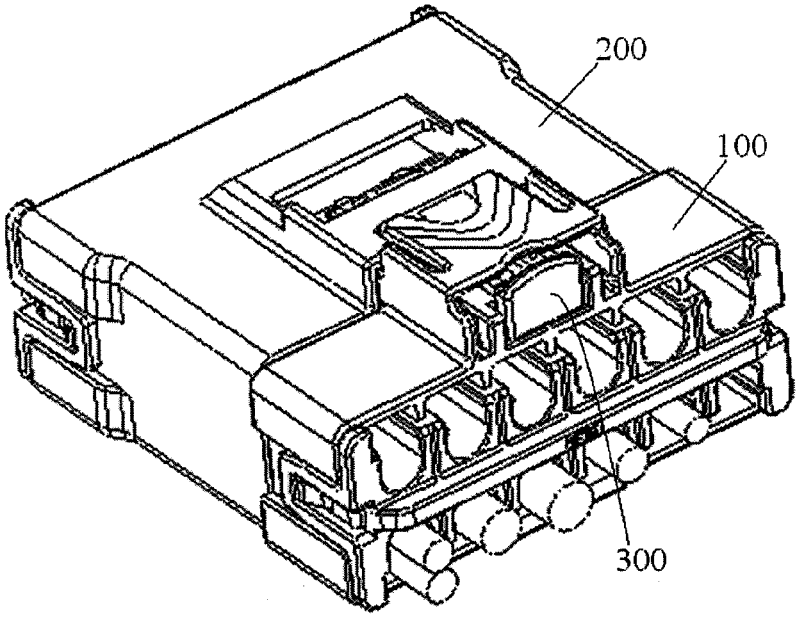
FIG. 12 is an illustrative view of a connector assembly, wherein the first connector of the connector product of FIG. 9 has been assembled into the second connector and the connector position assurance device has been further inserted forward from the first position to a second position (assembly position)

FIG. 11 is an illustrative view of a connector assembly, wherein the first connector 100 of the connector product of FIG. 9 has been assembled into the second connector 200 and the CPA 300 is located in the first position; FIG. 12 is an illustrative view of a connector assembly, wherein the first connector 100 of the connector product of FIG. 9 has been assembled into the second connector 200 and the CPA has been further inserted forward from the first position to a second position.

As shown in FIGS. 6-8, 11-12, when the first and second connectors 100, 200 are mated with each other, the first stopper release member 205 of the second connector 200 jacks up the first mating stopper 105 of the elastic locking piece 104 of the first connector 100 to separate the first mating stopper 105 from the first stopper 331, so that the CPA 300 can be further pushed forward from the first position to the second position.

Figure 13:
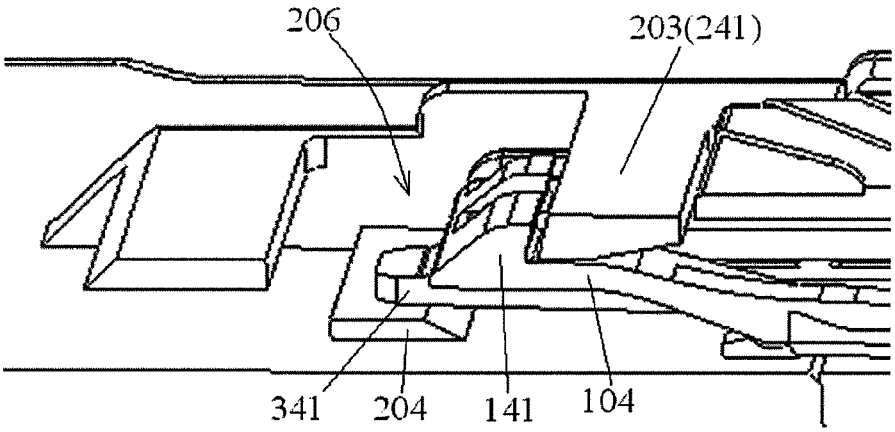
FIG. 13 is a partial cross section of the connector assembly shown in FIG. 12.

FIG. 13 is a partial cross section of the connector assembly shown in FIG. 12.

As shown in FIG. 13, at the second position, the CPA 300 holds the elastic locking piece 104 of the first connector 100 in a locked state where the elastic locking piece 104 of the first connector 100 is locked with the locking member 241 of the second connector 200, so as to prevent the first connector 100 from being released from the second connector 200.

As shown in FIGS. 2-3, a first positioning feature 311 is formed on the CPA 300, and a first mating positioning feature 107 is formed on the first housing of the first connector 100, as shown in FIG. 6. When the CPA 300 is inserted into the first position, the first positioning feature 311 of the CPA 300 is mated with the first mating positioning feature 107 of the first connector 100, so that an operator can feel whether the CPA 300 has been inserted into the first position of the first connector 100 through a change of a force of inserting the CPA 300 into the first connector 100 or a click of mating the first positioning feature 311 of the CPA 300 to the first mating positioning feature 107 of the first connector 100.

As shown in FIGS. 2-3, a second positioning feature 321 is formed on the CPA 300 behind the first positioning feature 311 in the insertion direction of the CPA 300 into the second connectors 200. During the CPA 300 is pushed forward from the first position to the second position, the first positioning feature 311 of the CPA 300 is disengaged from the first mating positioning feature 107 of the first connector 100, and the second positioning feature 321 of the CPA 300 is then mated with the first mating positioning feature 107 of the first connector 100. In this way, the operator can feel whether the CPA 300 has been inserted into the second position through a change of a force of inserting the CPA 300 into the connector assembly or a click of mating the second positioning feature 321 of the CPA 300 to the first mating positioning feature 107 of the first connector 100.

As shown in FIGS. 2-3, in an embodiment of the present invention, the CPA 300 mainly comprises a pair of elongated arms 301, 302 separated from each other by a spacing slot 304, a bottom plate 303 recessedly disposed between the pair of elongated arms at a rear portion of the spacing slot 304, and a vertical wall plate 305 located at a rear end of the bottom plate 303 to facilitate the operator to insert the CPA 300 or draw the CPA 300 out with his/her fingers.

As shown in FIGS. 2-3, the first stopper 331 is configured to be a protrusion formed on and projected upward from the bottom plate 303.

As shown in FIGS. 5-6, the first mating stopper 105 is configured to be an elastic finger formed in an opening of the first elastic piece 104 and extending aslant and downward beyond a bottom surface of the first elastic piece 104.

As shown in FIGS. 2-3, the second stopper 312 is configured to be an elastic finger formed in an opening of the bottom plate 303 of the CPA 300 and extending aslant and downward beyond a bottom surface of the bottom plate 303.

As shown in FIGS. 5-6, the second mating stopper 106 is configured to be a protrusion formed on and projected upward from the first housing of the first connector 100.

As shown in FIGS. 4-6, in an embodiment of the present invention, a first chamber defined by a pair of side walls 101, 102 and a top wall 103 is formed on the housing of the first connector 100. The elastic locking piece 104 is suspended in the first chamber from the top wall 103 via an elastic beam 108.

As shown in FIGS. 2-3, the first positioning feature 311 is configured to be a pair of recesses formed in outer side walls of the pair of elongated arms 301, 302, respectively.

As shown in FIGS. 4-6, the first mating positioning feature 107 is configured to be a pair of protrusions formed on the pair of side walls 101, 102 in the first chamber, respectively.

As shown in FIGS. 2-3, the second positioning feature 321 is configured to be a pair of mating protrusions formed on the outer side walls of the pair of elongated arms 301, 302 and mated with the pair of protrusions 107 on the side walls 101, 102 in the first chamber, respectively.

As shown in FIGS. 2-3, and 5, a guide groove 351 is formed in a rear portion of the bottom plate 303 of the CPA 300 and mated with the second mating stopper 106 of the first housing of the first connector 100 to guide the insertion of the CPA 300 when inserting the CPA 300 toward the second connectors 200.

As shown in FIGS. 2-3, a pair of first locking hooks 341 are formed on free ends (distal end) of the pair of elongated arms 301, 302 of the CPA 300. In an embodiment, the first locking hooks 341 are formed as bending portions which are convex upward.

As shown in FIG. 4, at least one second locking hook 141 is formed on a front end (distal end) of the elastic locking piece 104 of the first connector 100.

As shown in FIG. 13, when the first and second connectors 100, 200 are mated with each other and when the CPA 300 is inserted into the second position, the second locking hook 141 of the elastic locking piece 104 of the first connector 100 is supported by the first locking hooks 341 of the CPA 300, so that the second locking hook 141 of the elastic locking piece 104 of the first connector 100 is held to be locked with the locking member 241 of the second connector 200.

As shown in FIGS. 7-8, a second chamber defined by a pair of side walls 201, 202 and a top wall 203 is formed on the housing of the second connector 200 and adapted to receive the elastic locking piece 104 inserted therein.

As shown in FIGS. 7-8, and 13, a window 206 is formed in the top wall 203 of the second chamber, so that a condition whether the CPA 300 is inserted into the second position can be watched, that is, the operator may watch whether the first locking hooks (protrusions or bending portion?) 341 of the CPA 300 is inserted beyond and held by the second locking hook 141 of the elastic locking piece 104 of the first connector 100. If the first locking hooks 341 of the CPA 300 have been inserted beyond and held by the second locking hook 141 of the elastic locking piece 104 of the first connector 100, it indicates that the CPA 300 has been inserted into the second position (assembly position).

As shown in FIGS. 7-8, and 13, the top wall 203 of the second chamber comprises a section of lateral plate constituting the locking member 241 of the second connector 200.

As shown in FIGS. 7-8, the first stopper release member 205 is configured to be a pair of projections formed on the second housing of the second connector 200, and a distance between the pair of projections is larger than a width of the first stopper 331 to allow the first stopper 331 to pass through between the pair of projections during inserting the CPA 300 from the first position to the second position.

As shown in FIGS. 7-8, and 13, a pair of protruded platforms 204 are formed on the second housing of the second connector 200 and configured to support the free ends of the pair of elongated arms 301, 302 when the CPA 300 is inserted into the second position so as to limit a downward deformation space of the pair of elongated arms 301, 302 and the elastic locking piece 104 which is lied against the elongated arms 301, 302. The downward deformation space is limited by the protruded platforms 204 to an extent of preventing the second locking hook 141 of the elastic locking piece 104 of the first connector 100 from being released from the locking member 241 of the second connector 200 and allowing the first locking hooks 341 of the elongated arms 301, 302 of the CPA 300 to be released from the second locking hook 141 of the elastic locking piece 104 of the first connector 100.

As shown in FIG. 13, when the first locking hooks 341 of the elongated arms 301, 302 of the CPA 300 are released from the protruded platforms 204 and the second locking hook 141 of the elastic locking piece 104 of the first connector 100 by pulling the CPA 300 in a direction opposite to the insertion direction with a relative larger force and when the CPA 300 is withdrawn from the second position to the first position, the elastic locking piece 104 of the first connector 100 can be offset downward to an extent of allowing the elastic locking piece 104 of the first connector 100 to be released from the locking member 241 of the second connector 200.

In an embodiment of the present invention, the first connector 100 is a plug connector, and the second connector 200 is a receptacle connector. But the present invention is not limited to this, the first connector 100 may be a receptacle connector, and the second connector 200 may be a plug connector.

As described above, the CPA 300 can be pre-attached to the housing of the first connector 100. Once the CPA 300 has been inserted into the first position of the first connector 100, the CPA 300 cannot be pulled out of the first connector 100 and can be used and sold together with the first connector 100 as an attachment of the first connector 100. Accordingly, before the first connector 100 is mated with the second connector 200, the CPA 300 cannot be lost and can be easily found when the operator needs to use the CPA 300 to hold the first and second connectors 100, 200 in a locked position.

Hereafter, it will describe the process of assembling the connector assembly of the present invention in detail by reference to FIGS. 9, 11-12.

Firstly, as shown in FIG. 9, inserting the CPA 300 into the first position of the first connector 100, that is, pre-attaching the CPA 300 to the first connector 100;

Secondly, as shown in FIG. 11, after the CPA 300 is pre-attached to the first connector 100, inserting the first connector 100 into the second connector 200;

Finally, as shown in FIG. 12, after the first connector 100 is inserted into the second connector 200, further inserting the CPA 300 forward from the first position to the second position.

When it needs to disassemble the connector assembly, the CPA 300 must be firstly withdrawn backward from the second position to the first position so that the first locking hooks 341 of the elongated arms 301, 302 of the CPA 300 are released from the protruded platforms 204 and the second locking hook 141 of the elastic locking piece 104 of the first connector 100, then the elastic locking piece 104 of the first connector 100 can be offset downward to a position where the elastic locking piece 104 is released from the locking member 241 of the second connector 200. After the CPA 300 has been withdrawn backward to the first position, the elastic locking piece 104 of the first connector 100 can be released from the locking member 241 of the second connector 200 to separate the first and second connectors 100, 200.

Although several embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A connector assembly comprising:

a first connector having a first housing on which an elastic locking piece is suspended;

a second connector having a second housing on which a locking member mated with the elastic locking piece is formed so as to lock the first and second connectors together when the first and second connectors are mated with each other; and a connector position assurance device having a first stopper and a second stopper behind the first stopper, wherein a first mating stopper is formed on the elastic locking piece, and a second mating stopper is formed on the first housing of the first connector, wherein the connector position assurance device is configured to be inserted into a first position under the elastic locking piece of the first connector when the first and second connectors are separate from each other, wherein at the first position, the first stopper of the connector position assurance device is abutted against the first mating stopper of the first connector to prevent the connector position assurance device from being further pushed forward, and at the first position, the second stopper of the connector position assurance device is abutted against the second mating stopper of the first connector to prevent the connector position assurance device from being pulled out backward;

wherein the first mating stopper is configured to be an elastic finger formed integrally with the elastic locking piece and being movable independently from the remainder of the elastic locking piece.

2. The connector assembly according to claim 1, wherein a first stopper release member is formed on the second housing of the second connector;

wherein the first stopper release member of the second connector is constructed to jack up the first mating stopper of the elastic locking piece of the first connector to separate the first mating stopper from the first stopper when the first and second connectors are mated with each other, so that the connector position assurance device is allowed to be further pushed forward from the first position to a second position;

wherein at the second position, the elastic locking piece of the first connector is held in a locked state, where the elastic locking piece of the first connector is locked with the locking member of the second connector, by the connector position assurance device.

3. The connector assembly according to claim 2, wherein a first positioning feature is formed on the connector position assurance device, and a first mating positioning feature is formed on the first housing of the first connector, wherein when the connector position assurance device is inserted into the first position, the first positioning feature of the connector position assurance device is mated with the first mating positioning feature of the first connector.

4. The connector assembly according to claim 3, wherein a second positioning feature is formed on the connector position assurance device behind the first positioning feature, wherein when the connector position assurance device is pushed forward from the first position to the second position, the first positioning feature of the connector position assurance device is disengaged from the first mating positioning feature of the first connector, and the second positioning feature of the connector position assurance device is mated with the first mating positioning feature of the first connector.

5. The connector assembly according to claim 4, wherein the connector position assurance device comprising:

a pair of elongated arms separated from each other by a spacing slot; and a bottom plate recessedly disposed between the pair of elongated arms at a rear portion of the spacing slot.

6. The connector assembly according to claim 5, wherein the first stopper is configured to be a protrusion projected upward from the bottom plate; and wherein the first mating stopper is formed in an opening of the elastic locking piece and extending aslant and downward beyond a bottom surface of the elastic locking piece.

7. The connector assembly according to claim 6, wherein the second stopper is configured to be an elastic finger formed in an opening of the bottom plate of the connector position assurance device and extending aslant and downward beyond a bottom surface of the bottom plate; and wherein the second mating stopper is configured to be a protrusion projected upward from the first housing of the first connector.

8. The connector assembly according to claim 7, wherein a first chamber defined by a pair of side walls and a top wall is formed on the first housing of the first connector; and wherein the elastic locking piece is suspended in the first chamber from the top wall.

9. The connector assembly according to claim 8, wherein the first positioning feature is configured to be a pair of recesses formed in outer side walls of the pair of elongated arms, respectively; and wherein the first mating positioning feature is configured to be a pair of protrusions formed on the pair of side walls in the first chamber, respectively.

10. The connector assembly according to claim 9, wherein the second positioning feature is configured to be a pair of mating protrusions formed on the outer side walls of the pair of elongated arms and mated with the pair of protrusions on the side walls in the first chamber, respectively.

11. The connector assembly according to claim 10, wherein a guide groove is formed in a rear portion of the bottom plate of the connector position assurance device and configured to be mated with the second mating stopper of the housing of the first connector to guide the insertion of the connector position assurance device.

12. The connector assembly according to claim 11, wherein a pair of first locking hooks are formed on free ends of the pair of elongated arms of the connector position assurance device, respectively;

wherein at least one second locking hook is formed on a front end of the elastic locking piece of the first connector; and wherein when the first and second connectors are mated with each other and when the connector position assurance device is inserted into the second position, the second locking hook of the elastic locking piece of the first connector is locked with the locking member of the second connector, and the first locking hooks of the connector position assurance device is locked with the second locking hook of the elastic locking piece of the first connector.

13. The connector assembly according to claim 12, wherein a second chamber defined by a pair of side walls and a top wall move is formed on the second housing of the second connector and adapted to receive the elastic locking piece inserted therein.

14. The connector assembly according to claim 13, wherein a window is formed in the top wall of the second chamber, so that a condition whether the connector position assurance device is inserted into the second position is watched.

15. The connector assembly according to claim 14, wherein the top wall of the second chamber comprises a section of lateral plate constituting the locking member of the second connector.

16. The connector assembly according to claim 15, wherein the first stopper release member is configured to be a pair of projections formed on the second housing of the second connector; and wherein a distance between the pair of projections is larger than a width of the first stopper to allow the first stopper to pass through between the pair of projections during inserting the connector position assurance device from the first position to the second position.

17. The connector assembly according to claim 16, wherein a pair of protruded platforms are formed on the second housing of the second connector and configured to support the free ends of the pair of elongated arms when the connector position assurance device is inserted into the second position so as to limit a downward deformation space of the pair of elongated arms and the elastic locking piece lied against the elongated arms; and wherein the downward deformation space is limited to an extent of preventing the second locking hook of the elastic locking piece of the first connector from being released from the locking member of the second connector and allowing the first locking hooks of the elongated arms of the connector position assurance device to be released from the second locking hook of the elastic locking piece of the first connector.

18. The connector assembly according to claim 17, wherein when the first locking hooks of the elongated arms of the connector position assurance device are released from the protruded platforms and the second locking hook of the elastic locking piece of the first connector and when the connector position assurance device is withdrawn from the second position to the first position, the elastic locking piece of the first connector is allowed to offset downward to an extent of allowing the elastic locking piece of the first connector to be released from the locking member of the second connector.

19. The connector assembly according to claim 1, wherein the first connector is a plug connector, and the second connector is a receptacle connector.

20. A connector product comprising:

a first connector according to claim 1 wherein the connector position assurance device is inserted into the first position of the first connector.

21. A connector assembly comprising:

a first connector having a first housing on which an elastic locking piece is suspended;

a second connector having a second housing on which a locking member mated with the elastic locking piece is formed so as to lock the first and second connectors together when the first and second connectors are mated with each other;

a connector position assurance device having a first stopper and a second stopper behind the first stopper, the connector position assurance device further comprising a pair of elongated arms separated from each other by a spacing slot;

a pair of first locking hooks formed on free ends of the pair of elongated arms of the connector position assurance device, respectively;

at least one second locking hook is formed on a front end of the elastic locking piece of the first connector;

wherein a first mating stopper is formed on the elastic locking piece, and a second mating stopper is formed on the first housing of the first connector;

wherein the connector position assurance device is configured to be inserted into a first position under the elastic locking piece of the first connector when the first and second connectors are separate from each other;

wherein at the first position, the first stopper of the connector position assurance device is abutted against the first mating stopper of the first connector to prevent the connector position assurance device from being further pushed forward, and at the first position, the second stopper of the connector position assurance device is abutted against the second mating stopper of the first connector to prevent the connector position assurance device from being pulled out backward;

wherein a pair of protruded platforms are formed on the second housing of the second connector and configured to support the free ends of the pair of elongated arms when the connector position assurance device is inserted into a second position so as to limit a downward deformation space of the pair of elongated arms and the elastic locking piece lied against the elongated arms; and wherein the downward deformation space is limited to an extent of preventing the second locking hook of the elastic locking piece of the first connector from being released from the locking member of the second connector and allowing the first locking hooks of the elongated arms of the connector position assurance device to be released from the second locking hook of the elastic locking piece of the first connector.

22. The connector assembly according to claim 21, wherein when the first locking hooks of the elongated arms of the connector position assurance device are released from the protruded platforms and the second locking hook of the elastic locking piece of the first connector and when the connector position assurance device is withdrawn from the second position to the first position, the elastic locking piece of the first connector is allowed to offset downward to an extent of allowing the elastic locking piece of the first connector to be released from the locking member of the second connector.

* * * * *